US010772410B2

(12) United States Patent
Goulet et al.

(10) Patent No.: US 10,772,410 B2
(45) Date of Patent: Sep. 15, 2020

(54) CINCH PACK

(71) Applicant: The North Face Apparel Corp., Wilmington, DE (US)

(72) Inventors: Alexandre Goulet, Wilmington, DE (US); Andrew Coutant, Dublin, CA (US)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 16/239,678

(22) Filed: Jan. 4, 2019

(65) Prior Publication Data

US 2020/0214429 A1 Jul. 9, 2020

(51) Int. Cl.
*A45F 3/04* (2006.01)
*A45F 3/12* (2006.01)

(52) U.S. Cl.
CPC ..... *A45F 3/047* (2013.01); *A45F 3/12* (2013.01); *A45F 2003/122* (2013.01)

(58) Field of Classification Search
CPC .... A45F 3/047; A45F 3/04; A45F 3/06; A45F 3/08; A45F 3/12; A45F 2003/045; A45F 2003/122
USPC ..... 224/627–659
See application file for complete search history.

(56) References Cited

U.S. PATENT DOCUMENTS

| | | | | |
|---|---|---|---|---|
| 7,059,503 | B2 * | 6/2006 | Andersen | A45F 3/14 224/578 |
| 8,020,730 | B2 * | 9/2011 | Liang | A45F 3/04 222/175 |
| 9,585,462 | B2 * | 3/2017 | Engdahl | A45F 3/04 |
| 2002/0170932 | A1 * | 11/2002 | Higgins | A45F 3/04 224/156 |
| 2006/0131355 | A1 * | 6/2006 | Tate | A45F 3/047 224/637 |
| 2006/0289586 | A1 * | 12/2006 | Gregory | A45F 3/04 224/627 |
| 2009/0206118 | A1 * | 8/2009 | Sabbah | A45C 13/02 224/652 |
| 2010/0308086 | A1 * | 12/2010 | Chapuis | A45F 3/04 224/148.2 |
| 2013/0043292 | A1 * | 2/2013 | White | A45F 3/047 224/607 |
| 2016/0174691 | A1 * | 6/2016 | Chapuis | A45F 3/047 224/605 |
| 2017/0231369 | A1 * | 8/2017 | Ly | A45F 3/12 224/637 |

* cited by examiner

*Primary Examiner* — Scott T McNurlen
(74) *Attorney, Agent, or Firm* — Smith, Gambrell & Russell LLP

(57) ABSTRACT

A backpack may comprise a main body defining a first compartment, a first shoulder strap extending from the main body, a second shoulder strap extending from the main body, a cinching layer disposed adjacent an exterior surface of the main body, a first cinching cord coupled to the first shoulder strap and the second shoulder strap, and a second cinching cord coupled to the main body and extending through at least a portion of the cinching layer, wherein the second cinching cord is slideably coupled to the first cinching cord such that a tension applied to the first cinching cord causes the cinching layer to apply a compression force from the cinching layer toward the front exterior surface of the main body.

15 Claims, 6 Drawing Sheets

CINCH PACK

TECHNICAL FIELD

The present disclosure generally relates to backpacks, which can be used for travelling, or in a wide range of activities, such as hiking, camping, fishing, and the like.

BACKGROUND

Backpacks allow users to carry items by distributing the load across the users' shoulders and back. Typically, a backpack is held on a user's shoulders by shoulder straps, through which the user inserts her arms. A backpack may also include a hip belt to further secure the load, preventing excessive rotation on the user's back. Carrying cargo in a backpack can be a comfortable alternative to hand-carrying.

Due to varying body types and postures among users of backpacks, simple adjustability of a backpack's shoulder straps and hip belt are desirable. In order to have shoulder straps that better contour to a user's back and shoulders, some backpacks include load-stabilizing straps attached to the shoulder straps and body. However, conventional backpacks often have two individual load-stabilizing straps—one for each shoulder strap—and these load-stabilizing straps are separately adjustable. Therefore, a user must adjust each strap individually and coordinate the settings of each so that the backpack can rest symmetrically on the user's back. Also, separate and independent load-stabilizing straps are unable to function cooperatively to shift the position of the shoulder straps and load in response to a user's movements. User comfort is limited in this respect.

Additionally, some backpacks offer adjustability of the position of the hip belt. However, conventional adjustment mechanisms are difficult to use and may require a user to take off the backpack or partially disassemble the backpack to make an adjustment, especially in cases where a length between shoulder straps and a hip belt is adjusted.

Accordingly, there is a need for an improved load adjustment system for backpacks which allows users to quickly and easily adjust the positions of the shoulder straps and hip belt.

SUMMARY

The present disclosure relates to a backpack for adjusting a cinching or compression force of the backpack against a body of the wearer.

In an aspect, a backpack may comprise: a main body comprising a front exterior surface and a rear exterior surface disposed opposite the front exterior surface, the main body further comprising one or more interior surfaces defining a first compartment; a support panel disposed adjacent at least a portion of the rear exterior surface of the main body and coupled to the main body; a first shoulder strap extending from the support panel; a second shoulder strap extending from the support panel, wherein at least a portion of the second shoulder strap is spaced from the first shoulder strap; a cinching layer disposed adjacent the front exterior surface of the main body; a first hip member extending through at least one first main body ring coupled to the main body and at least one first shoulder strap ring coupled to the first shoulder strap, the first hip member adjustably coupled to a first anchor coupled to the main body; a second hip member extending through at least one second main body ring coupled to the main body and at least one second shoulder strap ring coupled to the second shoulder strap, the second hip member adjustably coupled to a second anchor coupled to the main body, wherein the second hip member is configured to be releasable coupled with the first hip member to define an adjustable hip belt, and wherein adjustment of a tension in the hip belt causes adjustment of a cinching force between the first and second shoulder strap and the support panel; a first cinching cord coupled to the first shoulder strap and the second shoulder strap, wherein the coupling between the first cinching cord and one or more of the first shoulder strap and the second shoulder strap comprises an adjustable coupling, and wherein at least a portion of the first cinching cord is disposed adjacent a top end of the front exterior surface of the main body; and a second cinching cord coupled to the main body and extending through at least a portion of the cinching layer, wherein at least a portion of the second cinching cord is disposed adjacent a top end of the cinching layer and is coupled to the first cinching cord such that a tension applied to the first cinching cord causes the cinching layer to apply a compression force from the cinching layer toward the front exterior surface of the main body.

In another aspect, a backpack may comprise: a main body comprising a front exterior surface and a rear exterior surface disposed opposite the front exterior surface, the main body further comprising one or more interior surfaces defining a first compartment; a first shoulder strap extending from the main body; a second shoulder strap extending from the main body; a cinching layer disposed adjacent the front exterior surface of the main body; a first cinching cord coupled to the first shoulder strap and the second shoulder strap, wherein the coupling between the first cinching cord and one or more of the first shoulder strap and the second shoulder strap comprises an adjustable coupling, and wherein at least a portion of the first cinching cord is disposed adjacent a top end of the front exterior surface of the main body; and a second cinching cord coupled to the main body and extending through at least a portion of the cinching layer, wherein at least a portion of the second cinching cord is disposed adjacent a top end of the cinching layer and is coupled to the first cinching cord such that a tension applied to the first cinching cord causes the cinching layer to apply a compression force from the cinching layer toward the front exterior surface of the main body.

In another aspect, a backpack may comprise: a main body defining a first compartment, a first shoulder strap extending from the main body, a second shoulder strap extending from the main body, a first cinching cord coupled to the first shoulder strap and the second shoulder strap, and a second cinching cord coupled to the main body and slideably coupled to the first cinching cord such that a tension applied to the first cinching cord causes a compression force from the cinching layer toward the front exterior surface of the main body.

The present disclosure relates to methods of making and using a backpack.

BRIEF DESCRIPTION OF THE DRAWINGS

The following drawings illustrate generally, by way of example, but not by way of limitation, various examples discussed in the present disclosure. In the drawings.

DETAILED DESCRIPTION

Figure 1:
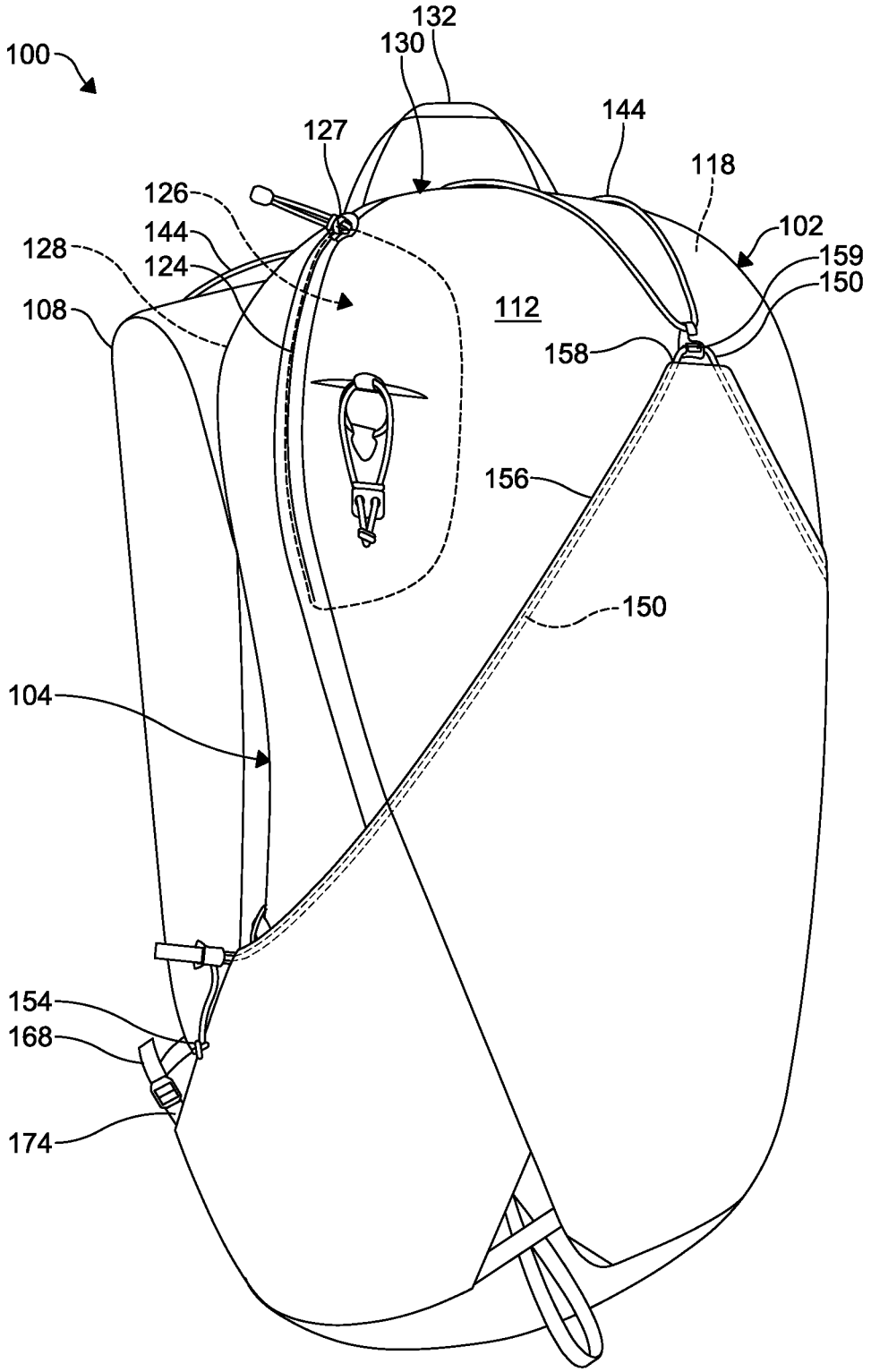
FIG. 1 shows a front perspective view of an example backpack in accordance with the present disclosure.
Figure 2:
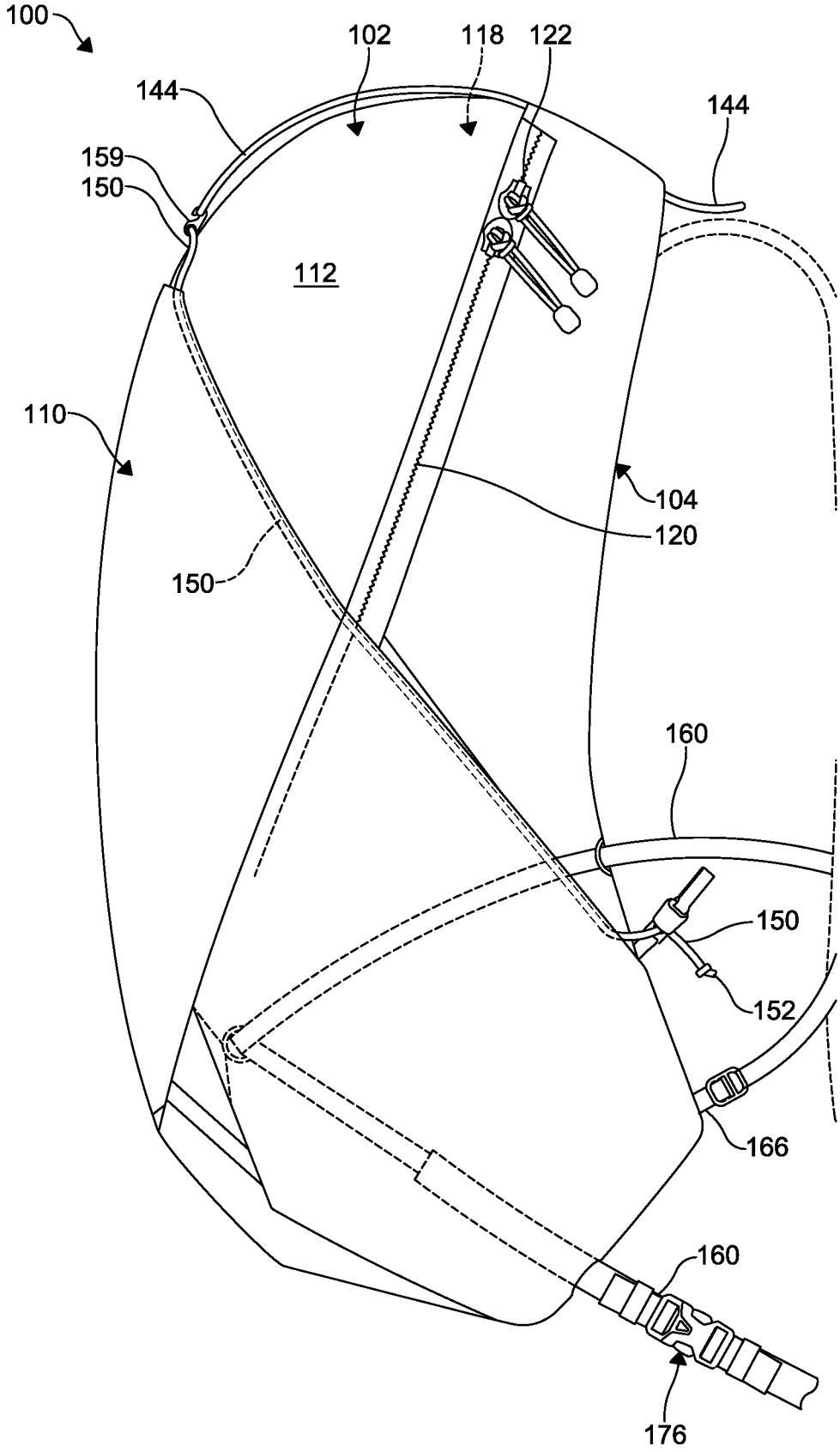
FIG. 2 shows a right side view of the backpack of FIG. 1.
Figure 3:
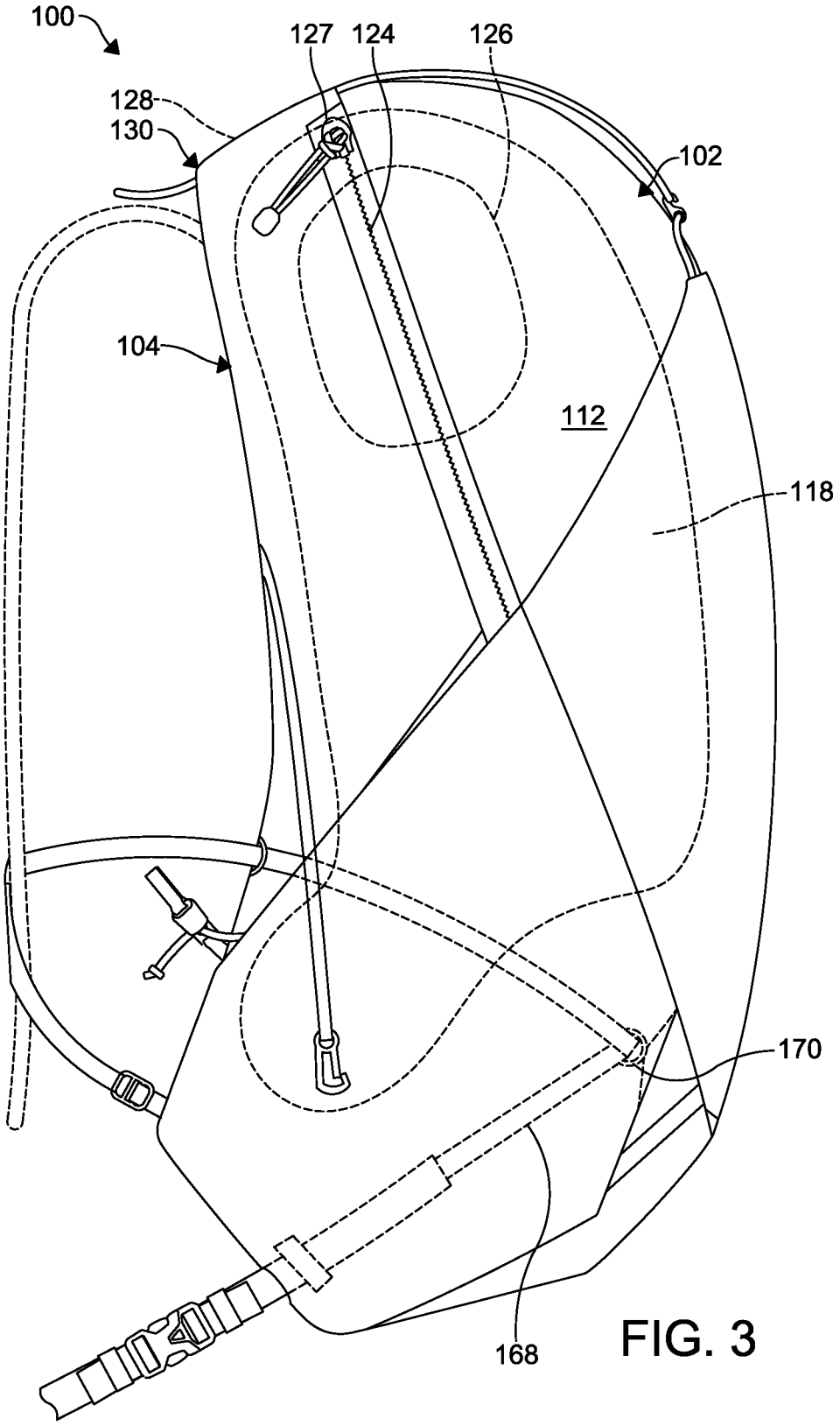
FIG. 3 shows a left side view of the backpack of FIG. 1.
Figure 4:
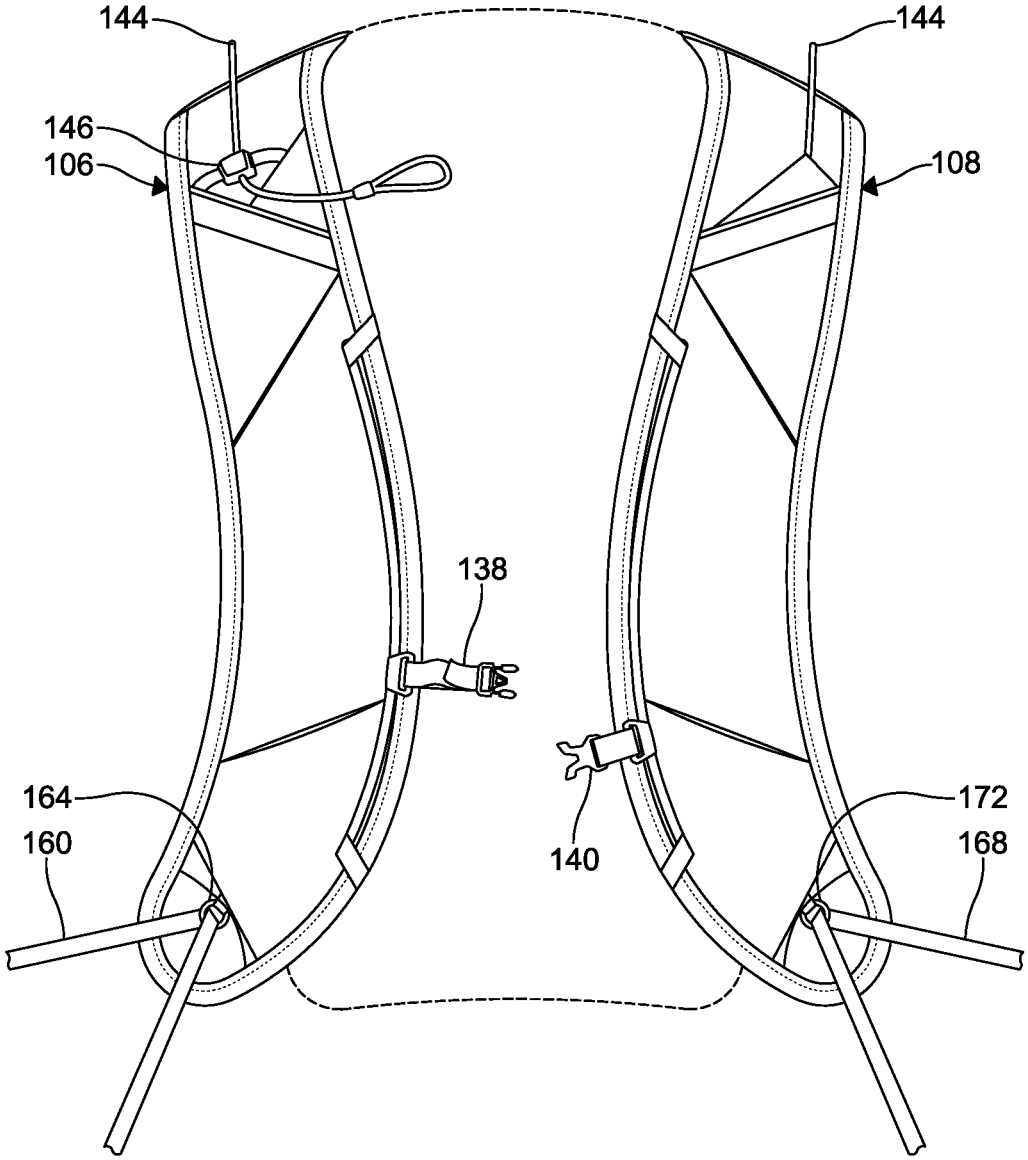
FIG. 4 shows a pair of shoulder straps in accordance with the present disclosure.
Figure 5:
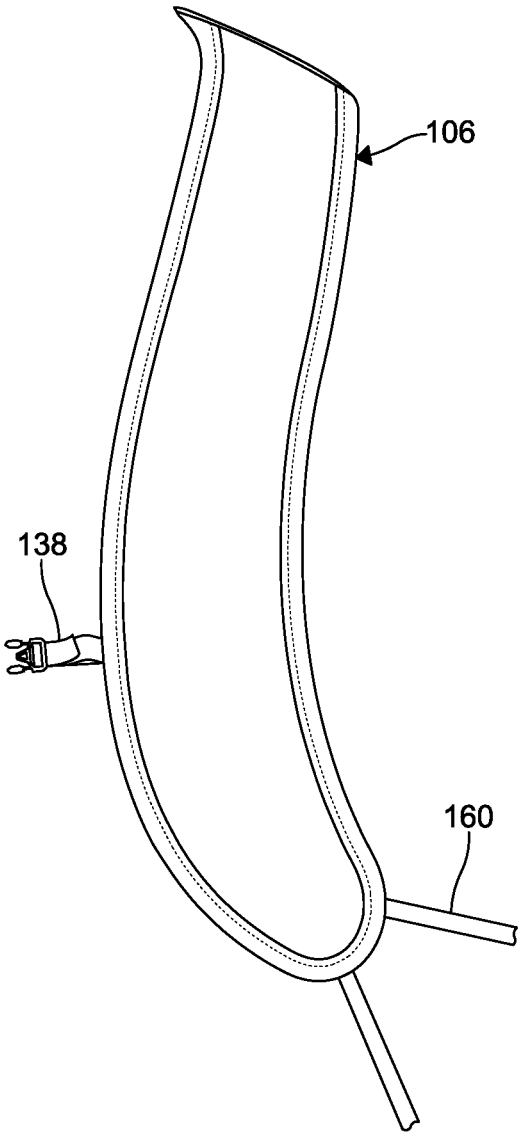
FIG. 5 shows a shoulder strap in accordance with the present disclosure.

FIGS. 1-6 show an example assembly that may be a backpack 100. Although the backpack 100 shows configurations of certain elements and features of the present disclosure, it is understood that other arrangements may be made without departing from the spirit of the present disclosure. Although reference is made to a backpack, such reference is an example only and the features claimed may reference other articles.

The backpack 100 may comprise a main body 102, a support panel 104, one or more shoulder straps 106, 108, and a cinching layer 110. In certain aspects, the main body 102 may comprise the support panel. Other layers, structures and supporting members maybe be used. Various materials, fixtures, fasteners, pockets, handles, hooks, cords, and other features may be used.

The main body 102 may comprise a front exterior surface 112 and a rear exterior surface 114 disposed opposite the front exterior surface 112. The main body 102 may comprise one or more interior surfaces defining a first compartment 118. It is understood that various constructions may be used and may incorporate various materials (e.g., webbing) to define the first compartment 118 and/or other features of the main body 102. A first aperture 120 may be formed in the main body 102 and may be configured to allow access to the first compartment 118. A first fastening mechanism 122 (e.g., a zipper-type fastener) may be configured to selectively open or close at least a portion of the first aperture 120. Other fasteners may be used. A second aperture 124 may be formed in the main body 102 and may be configured to allow access to a second compartment 126 disposed in or defined by the main body 102. As an example, the second compartment 126 may be formed from a material that at least partially extends into the first compartment 118 such that the second compartment 126 is at least partially disposed within the first compartment 118. A second fastening mechanism 127 (e.g., zipper-type fastener, snaps, hook and loop, etc.) may be configured to selectively open or close at least a portion of the second aperture 124.

Various supporting materials may be comprised in and/or adjacent the main body 102. A semi-rigid material 128 (e.g., tubing) may be used to support a portion of the main body 102 such as a top portion 130 (e.g., top end) of the main body 102. A handle 132 may be disposed at or adjacent the top portion 130.

Figure 6:
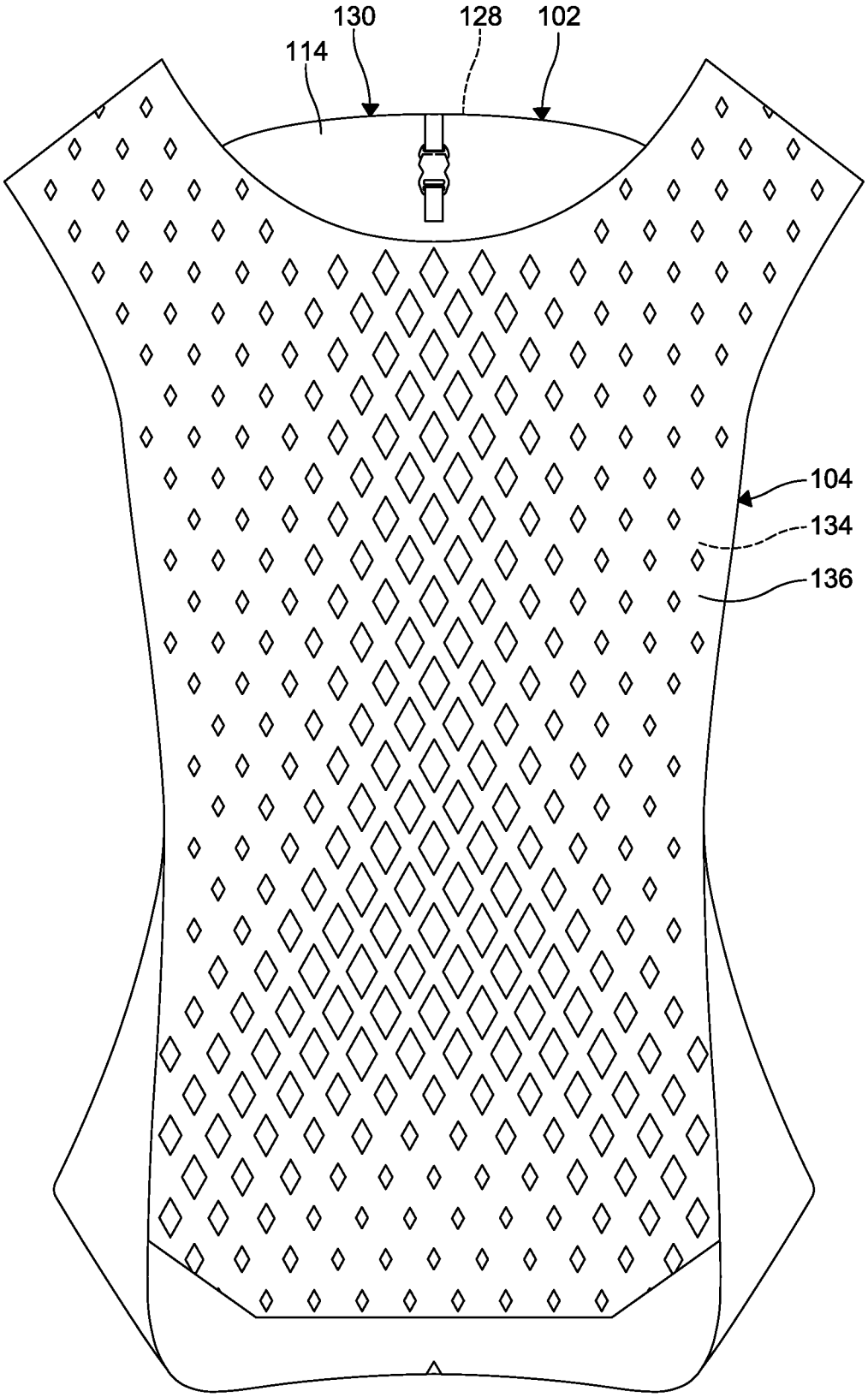
FIG. 6 shows an example support panel in accordance with the present disclosure.

The support panel 104 may be disposed adjacent at least a portion of the rear exterior surface 114 of the main body 102. The support panel 104 may be coupled to the main body 102. The support panel 104 may comprise a foam support member 134 at least partially enclosed in a material 136. An example foam support member 134 is shown in FIG. 6. As shown, the foam support member 134 may have an ergonomic shape configured to abut a back of a wearer. Other shapes and designs may be used.

A first shoulder strap 106 may extend from one or more of the main body 102 and the support panel 104. A second shoulder strap 108 may extend from one or more of the main body 102 the support panel 104. At least a portion of the second shoulder strap 108 may be spaced from the first shoulder strap 106. One or more of the shoulder straps 106, 108 may comprise a flexible, semi-rigid, or rigid material at least partial enclosed by a covering material. However, other constructions may be used. One or more of the shoulder straps 106, 108 may comprise pockets, tabs, compartments, and/or fasteners. A first chest member 138 coupled to the first shoulder strap 106 and a second chest member 140 coupled to the second shoulder strap 108. The first chest member 138 may be configured to be releasably coupled to the second chest member 140, for example across a torso of a wearer. Such releasable coupling may be effectuated using a technical buckle or other releasable fastener.

The cinching layer 110 may be disposed in or adjacent the front exterior surface 112 of the main body 102. The cinching layer 110 may be disposed adjacent other portions of the main body 102 or may be integrated as part of the main body 102. The cinching layer 110 may be formed from various materials and may be stretchable in one or more areas, or formed from an elastic material. The cinching layer 110 may comprise webbing or may be defined by cords or drawstrings, or the like.

A first cinching cord 144 may be coupled to one or more of the first shoulder strap 106 and the second shoulder strap 108. The term cord, as used herein, need not have a particular cross-section and may be flat material or have a defined cross-sectional shape such as circular, oval, rectangular, or other shapes or sizes. The coupling between the first cinching cord 144 and one or more of the first shoulder strap 106 and the second shoulder strap 108 may be effectuated by an adjustable coupling mechanism 146 such as a cord lock, for example. At least a portion of the first cinching cord 144 may be disposed adjacent the top portion 130 of the main body. As an illustrative example, the first cinching cord 144 may be fixedly coupled to the second shoulder strap 108, may pass through at least a portion of the main body 102 (e.g., such that a portion is enclosed and a potion is not enclosed by the main body 102) and may be slideably coupled to the first shoulder strap 106 such that a portion (e.g., an end 148) of the first cinching cord 144 may be engaged by a wearer of the backpack 100 to adjust a tension force applied to the first cinching cord 144.

A second cinching cord 150 may be coupled to the main body 102 and may extend through at least a portion of the cinching layer 110. One or both of the first cinching cord 144 or the second cinching cord 150 may define the cinching layer 110, or at least a portion of the cinching layer 110. The cinching layer 110 need not be a separate layer of material from the main body 102 to function as described herein. Opposing ends 152, 154 of the second cinching cord 150 may be fixedly coupled to the main body 102. As another example, the second cinching cord 150 may be at least partial enclosed by the cinching layer 110. The second cinching cord 150 may extend along or adjacent a peripheral edge 156 of the cinching layer 110. At least a portion of the second cinching cord 150 may disposed adjacent a top end 158 of the cinching layer 110. The second cinching cord 150 may be coupled to the first cinching cord 144 such that a tension applied to the first cinching cord causes the cinching layer 110 to apply a compression force from the cinching layer 110 toward main body 102 (e.g., toward the front exterior surface 112 of the main body 102. As an example, the second cinching cord 150 may be slidably coupled to the first cinching cord 144, for example using a hook-type coupler 159. The cinching layer 110 may comprise the cinching cords 144, 150 without or without additional material.

A first hip member 160 may extend through at least one first main body ring 162 coupled to the main body 102 and at least one first shoulder strap ring 164 coupled to the first shoulder strap 106. As used herein, ring may comprise an O-ring, D-ring, a material loop, or a tie-down fastener coupled to a surface and configured to allow a material to pass through an aperture formed in the fastener. The first hip member 160 may be adjustably coupled to a first anchor 166 coupled to the main body 102.

A second hip member 168 may extend through at least one second main body ring 170 coupled to the main body 102 and at least one second shoulder strap ring 172 coupled to the second shoulder strap 108. The second hip member 168 may be adjustably coupled to a second anchor 174 coupled to the main body 102. The first hip member 160 and/or the second hip member 168 may be configured to be releasable coupled to each other to define an adjustable hip belt 176. An adjustment of a tension in the hip belt 176 causes adjustment of a cinching force between the first and second shoulder straps 106, 108 and one or more of the main body 102 or the support panel 104. As an example, the cinching force between the first and second shoulder straps 106, 108 and one or more of the main body 102 or the support panel 10 may cause a tension in the first cinching cord 144 (e.g., since the first cinching cord 144 is coupled to the shoulder straps 106, 108). As such, the compression force from the cinching layer 110 toward the main body 102 may dependent upon the tension in the hip belt 176 and the tension applied to the first cinching cord 144 (which may be translated to the second cinching cord 150).

In use, a wearer of the backpack 100 may have items stored in one or more of the compartments 118, 126, or the backpack 100 may be empty. The wearer may be coupled the hip members 160, 168 to each other around a waist or hip area of the wearer, thereby defining the hip belt 176. The wearer may adjust a length of the hip belt 176, which will also apply a cinching force between the shoulder straps 106, 108 and the main body 102. The wearer may reach and engage the first cinching cord 144 (e.g., the end 148). The wearer may engage a release and may pull the first cinching cord 144 to apply a tension in the first cinching cord 144, which is translated to the second cinching cord 150, thereby causing the cinching layer 110 to experience a generally upward or tension force. As the cinching layer 110 is under force, the cinching layer will cause a compression force to be applied to the front exterior surface 112 of the main body 102, thus compressing the compartments 118, 126 toward a body of the wearer. The wearer may loosen the hip belt 176 and/or may release tension in the first cinching cord 144 to release compression of the compartments 118, 126.

What is claimed:

1. A backpack comprising:

a main body comprising a front exterior surface and a rear exterior surface disposed opposite the front exterior surface, the main body further comprising one or more interior surfaces defining a first compartment;

a first shoulder strap extending from the main body;

a second shoulder strap extending from the main body;

a cinching layer disposed adjacent the front exterior surface of the main body;

a first cinching cord coupled to the first shoulder strap and the second shoulder strap, wherein the coupling between the first cinching cord and one or more of the first shoulder strap and the second shoulder strap comprises an adjustable coupling, and wherein at least a portion of the first cinching cord is disposed adjacent a top end of the front exterior surface of the main body; and a second cinching cord coupled to the main body and extending through at least a portion of the cinching layer, wherein at least a portion of the second cinching cord is disposed adjacent a top end of the cinching layer and is coupled to the first cinching cord such that a tension applied to the first cinching cord causes the cinching layer to apply a compression force from the cinching layer toward the front exterior surface of the main body.

2. The backpack of claim 1, further comprising a first hip member extending through at least one first main body ring coupled to the main body and at least one first shoulder strap ring coupled to the first shoulder strap, the first hip member adjustably coupled to a first anchor coupled to the main body.

3. The backpack of claim 2, further comprising a second hip member extending through at least one second main body ring coupled to the main body and at least one second shoulder strap ring coupled to the second shoulder strap, the second hip member adjustably coupled to a second anchor coupled to the main body.

4. The backpack of claim 3, wherein the second hip member is configured to be releasably coupled with the first hip member to define an adjustable hip belt, and wherein adjustment of a tension in the hip belt causes adjustment of a cinching force between the first and second shoulder strap and the main body.

5. The backpack of claim 1, further comprising a first aperture formed in the main body and configured to allow access to the first compartment.

6. The backpack of claim 5, further comprising a first fastening mechanism configured to selectively open or close at least a portion of the first aperture.

7. The backpack of claim 1, further comprising a second aperture formed in the main body and configured to allow access to a second compartment disposed in or defined by the main body.

8. The backpack of claim 7, further comprising a second fastening mechanism configured to selectively open or close at least a portion of the second aperture.

9. The backpack of claim 1, wherein the main body comprises a support panel.

10. The backpack of claim 9, wherein the support panel comprises a foam support member at least partially enclosed in a material.

11. The backpack of claim 10, wherein the foam support member has a curvilinear shape configured to abut a back of a wearer.

12. The backpack of claim 1, further comprising a first chest member coupled to the first shoulder strap and a second chest member coupled to the second shoulder strap, wherein the first chest member is configured to be releasably coupled to the second chest member across a torso of a wearer.

13. The backpack of claim 1, wherein the adjustable coupling between the first cinching cord and one or more of the first shoulder strap and the second shoulder strap is effectuated using a cord lock.

14. The backpack of claim 1, wherein the adjustable coupling between the first cinching cord and one or more of the first shoulder strap and the second shoulder strap is configured to allow a portion of the first cinching cord to be engaged by a wearer of the backpack to adjust a tension force applied to the first cinching cord.

15. The backpack of claim 1, wherein the adjustable coupling between the first cinching cord and one or more of the first shoulder strap and the second shoulder strap is configured to allow an end of the first cinching cord to be engaged by a wearer of the backpack to adjust a tension force applied to the first cinching cord.

* * * * *